US005357872A

United States Patent [19]

Wilmore

[11] Patent Number: 5,357,872

[45] Date of Patent: Oct. 25, 1994

[54] FOLDING TABLE

[75] Inventor: James K. Wilmore, Gallatin, Tenn.

[73] Assignee: Globe Business Furniture, Inc., Hendersonville, Tenn.

[21] Appl. No.: 979,319

[22] Filed: Nov. 20, 1992

[51] Int. Cl.[5] ..... A47B 3/00

[52] U.S. Cl. ..... 108/35; 108/36; 108/132

[58] Field of Search ..... 108/34, 35, 36, 132

[56] References Cited

U.S. PATENT DOCUMENTS

| | | | |
|---|---|---|---|
| 677,442 | 7/1901 | Eames . | |
| 2,540,849 | 2/1951 | Walker . | |
| 2,643,926 | 6/1953 | Pucci . | |
| 2,747,957 | 2/1954 | Lencioni . | |
| 2,903,313 | 9/1959 | Block | 108/35 |
| 3,368,504 | 6/1967 | Cohen . | |
| 3,421,459 | 1/1969 | Sherwood . | |
| 4,341,164 | 7/1982 | Johnson . | |
| 4,826,244 | 5/1989 | Choi | 108/35 |
| 4,841,877 | 6/1989 | Virtue . | |
| 5,029,938 | 7/1991 | Song | 108/35 |

FOREIGN PATENT DOCUMENTS

| | | | |
|---|---|---|---|
| 22561 | 12/1891 | United Kingdom | 108/36 |
| 2181658 | 4/1987 | United Kingdom | 108/35 |

*Primary Examiner*—Michael Milano

*Attorney, Agent, or Firm*—Jacobson, Price, Holman & Stern

[57] ABSTRACT

A folding table has table top halves of molded plastic which are hinged together along a transverse center line of the table by a hinge assembly which includes spaced hinges with a common hinge pin. The hinge pin forms a carrying handle for the table which is exposed when the table is closed and which is concealed between the table top halves when the table is opened. The table top halves have integral moldings for fitting folding metal legs as well as telescopic longitudinal reinforcing bars and transverse reinforcing bars.

18 Claims, 8 Drawing Sheets

FOLDING TABLE

BACKGROUND OF THE INVENTION

This invention relates to a folding table of the kind having a table top formed by two table top halves hinged to each other along the center line of the table for folding together in the manner of a case, when the table is to be transported or stored, and for unfolding into a coplanar disposition to form the table top when the table is to be used. Each table top half, on its undersurface, carries a hinged leg assembly which can be positioned substantially flat against the undersurface when the table is folded and can swing out into an upright position to support the table top when the table is unfolded.

Folding tables of this kind should meet various requirements and the prior art is replete with different designs. For example, the table should be simple to unfold for setting up, and to fold for taking down. It should be as light in weight as possible, consistent with having sufficient rigidity when unfolded. These requirements are particularly important where, for example, the table is for use as a banquet table, and large numbers of such tables need to be set up and taken down at one time. Also, the table should be simple and economical to manufacture and should be simple and compact to transport and store.

It is an object of the present invention to provide a folding table of the kind described which, to a large extent, meets the above requirements.

SUMMARY OF THE INVENTION

In a folding table according to the invention, the table top halves are conveniently made of injection molded plastic with ribs on the undersurface and various molded recesses and fittings for attaching and receiving parts of the table hardware such as hinges for the table top, folding legs, supports for rigidifying the table top in use, and a carrying handle, any one or more of which parts may be made of metal.

One aspect of the invention resides in a novel form of carrying handle which is mounted on the hinge line between the table top halves, so as to be exposed for use when the table is folded and be hidden between the table top halves when they are unfolded. Preferably, for example, the table top halves are interconnected by a pair of hinges having a common hinge pin which, in its center portion, forms the carrying handle.

Another aspect of the invention resides in the provision of longitudinal telescopic support assemblies on the undersurface of the table top halves including male telescopic elements which are extended from respective tubular elements in one of the table top halves across the hinge line between the halves when the table is unfolded, and into further tubular elements on the other table top half to support and rigidify the table top. Conveniently, the tubular elements on the respective table top halves may fit over and lock in place transversely extending metal support bars which fit in molded transverse channels on the undersurfaces of the table top halves adjacent the hinge line. The transversely extending metal support bars may themselves fit over and lock in place projecting flanges on the hinges which attach the table top halves together, the hinges themselves being located in shallow pockets or the like formed in side walls of the transverse channels. With this arrangement, during assembly of the table, the hinge elements and transverse support bars can be fitted to the table top halves without the need for additional fasteners, and only the longitudinal tubular elements need be attached by fasteners, such as screws and brackets, to the respective table top halves.

Still another feature of the invention resides in a snap over toggle-type latch arrangement which fits over the respective transverse support bars to further rigidify the table top when it is open and ensure a close fit of the table top halves along the hinge line.

Additional features and advantages of the invention will be apparent from the ensuing description and claims read in conjunction with the attached drawings.

DESCRIPTION OF PREFERRED EMBODIMENT

Figure 1:
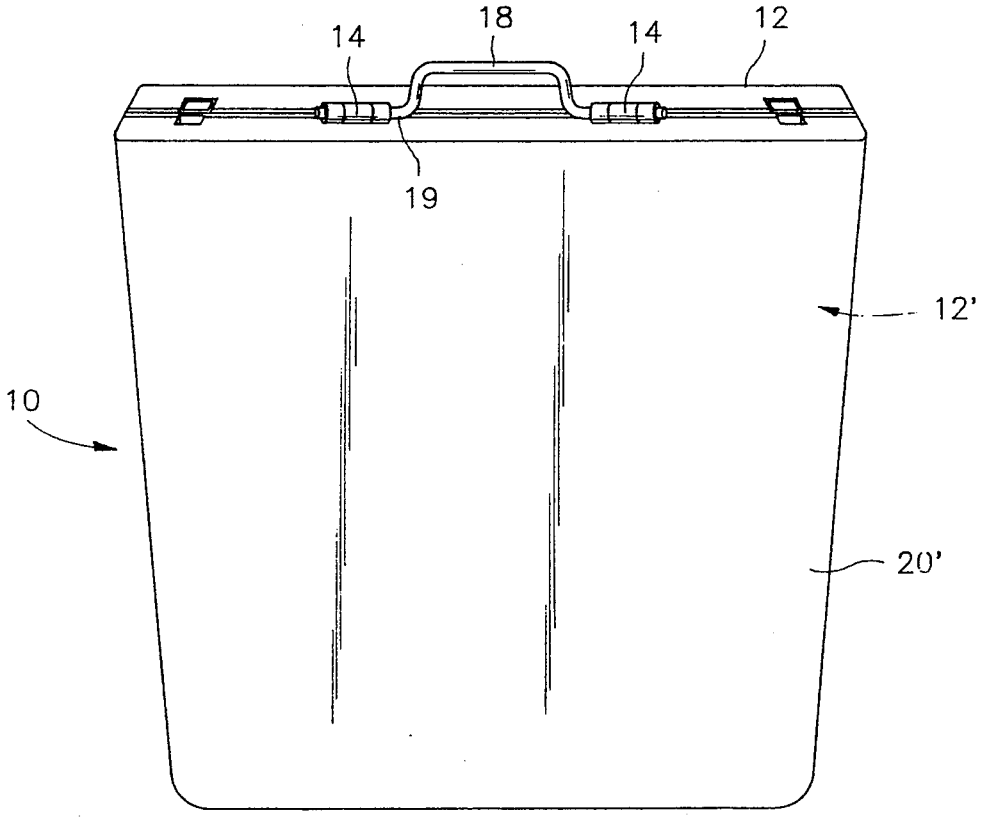
FIG. 1 is a perspective view of a folding table, showing the same in its folded position for carrying.
Figure 2:
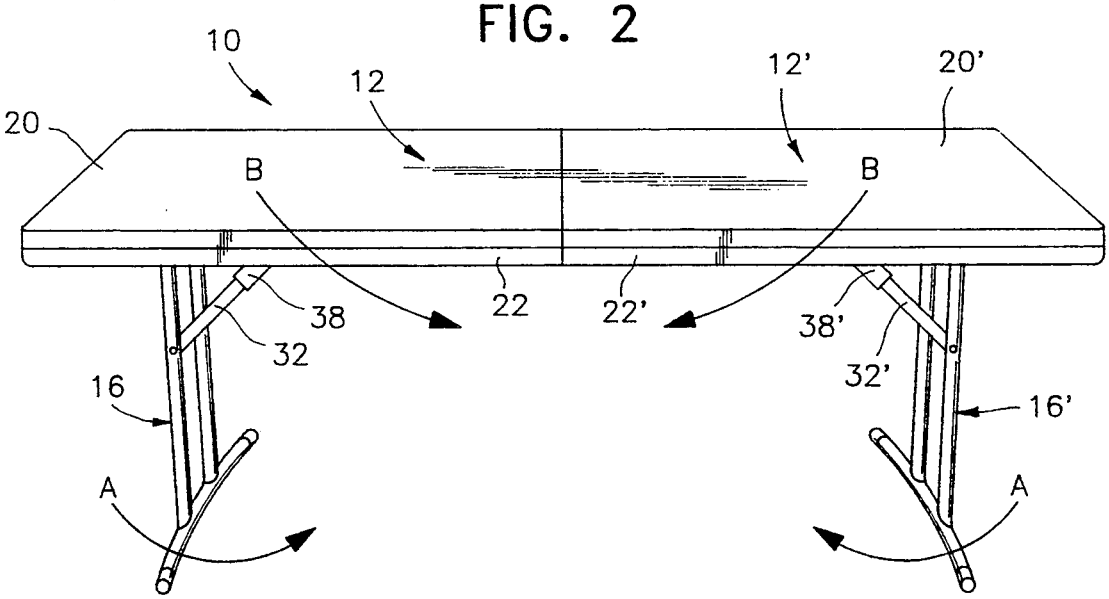
FIG. 2 is a perspective view of the table in the unfolded assembled position.

A folding table 10 according to the invention can be readily converted as between a folded condition shown in FIG. 1, for transport and storage, and an unfolded assembled position, shown in FIG. 2, for use of the table. The table has molded plastic left and right hand table top halves 12, 12' which are hinged together, generally along a transverse center line of the table by hinge assemblies 14, and the table top halves are provided with respective fold-out leg assemblies 16, 16'. From the unfolded assembled position shown in FIG. 2, the leg assemblies can be collapsed against the undersurface of the respective table top halves by pivoting the legs as indicated by arrows A, and the table top halves can then be folded together about the hinge assemblies in the direction of arrows B, in the manner of a case, to convert the table to the transport and storage condition shown in FIG. 1. Also, as evident in FIG. 1, handle 18, which is formed by a common hinge pin 19 connected between the assemblies 14, becomes exposed for readily carrying the table when it is folded. It is evident that to convert the table to its unfolded assembled condition, the above operations are reversed. In the unfolded condition, handle 18 is concealed between the table top halves at the center line of the table.

Figure 3:
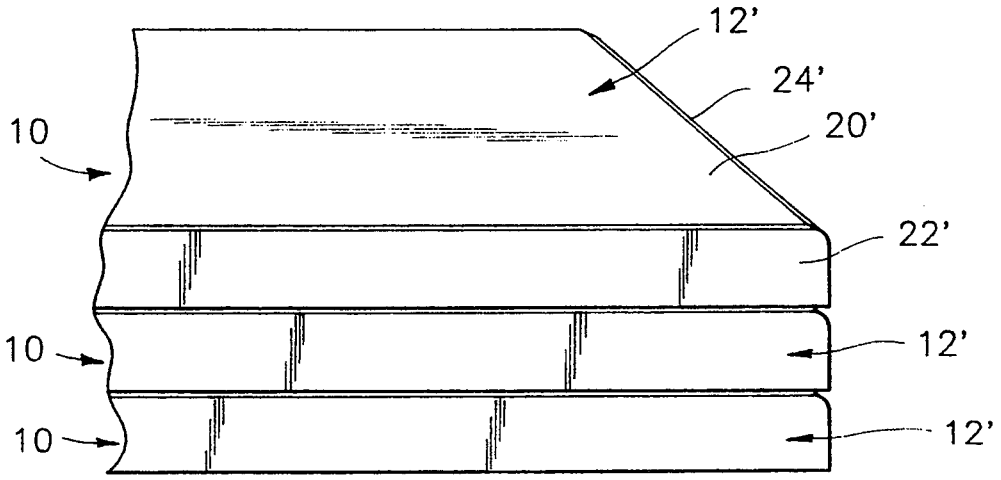
FIG. 3 is a partial view showing a plurality of tables according to the invention nested for storage.

Each of the table top halves 12 and 12' is in the form of a shallow tray or dish-like plastic molding having a top wall 20 or 20' with a depending peripheral flange 22 or 22'. Also, the table top halves may have peripherally extending ridges 24 or 24' or other formations allowing plural tables to be nested and stacked as shown in FIG. 3. Internally, each table top half provided with a latticework of longitudinal and transverse molded reinforcing ribs 26, 26' which are about half the height of the peripheral flanges 22, 22'.

Figure 13:
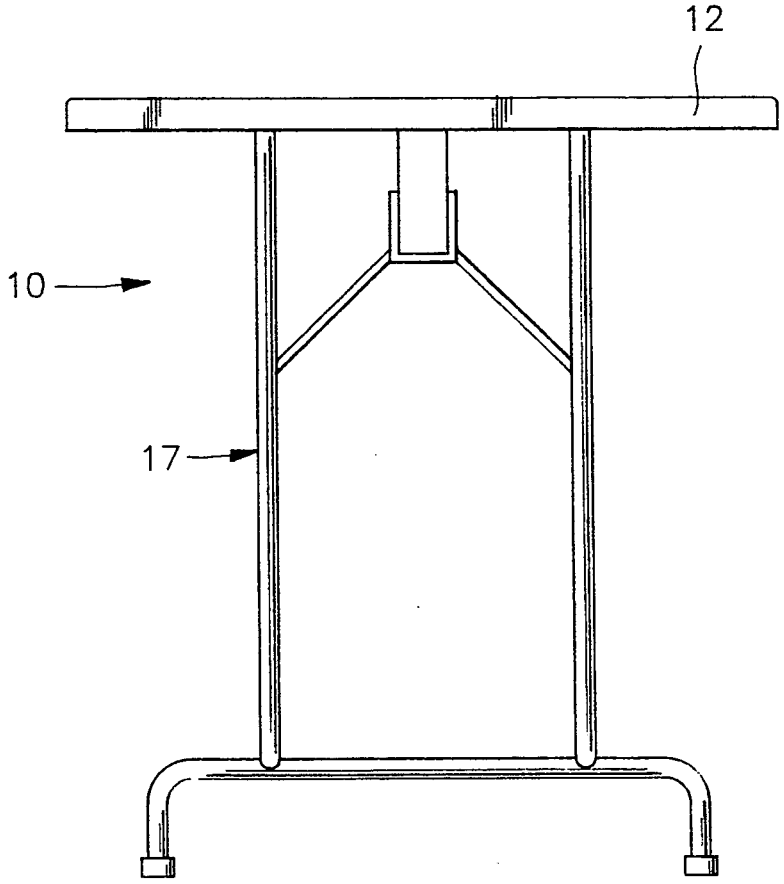
FIG. 13 is an end elevational view of the table, showing a different form of leg element.
Figure 8:
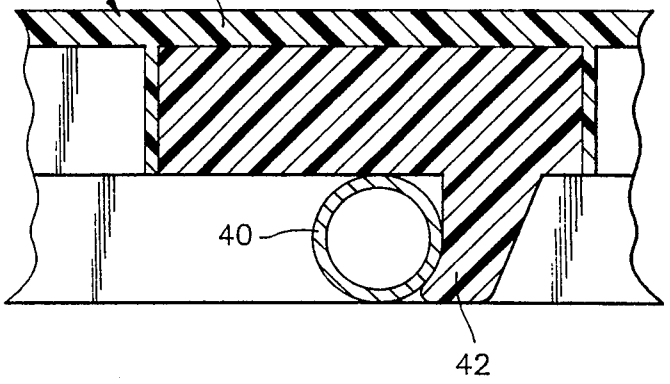
FIG. 8 is an enlarged cross-sectional view on line 8—8 of FIG. 4, showing in detail a locking means for holding the legs in their unfolded position.
Figure 7:
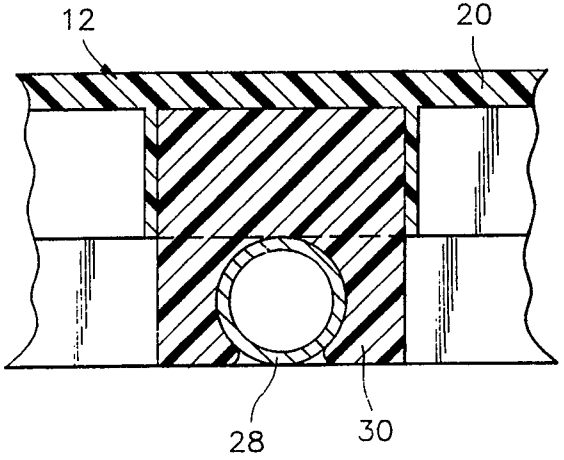
FIG. 7 is an enlarged cross-sectional view on line 7—7 of FIG. 4, showing an integral hinge support for the folding legs.
Figure 6A:
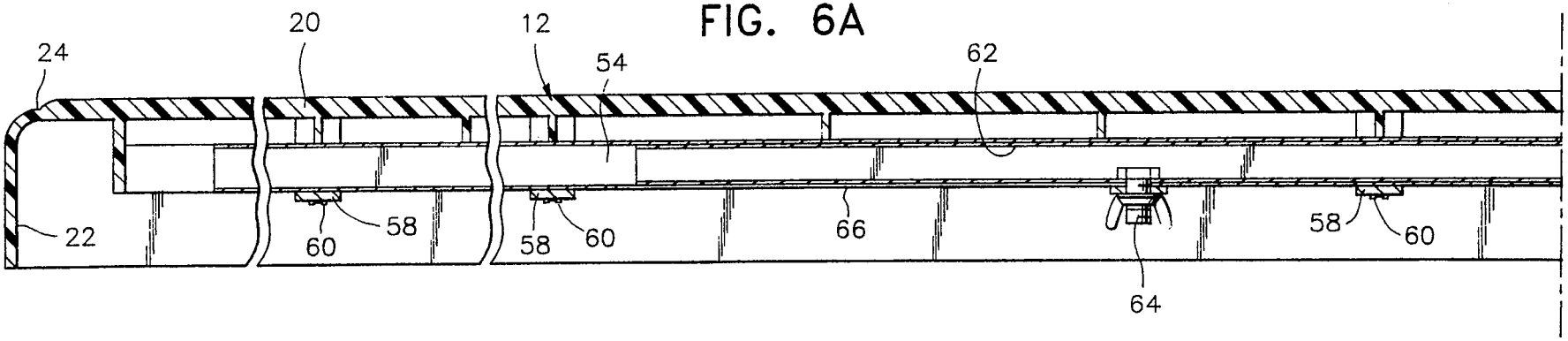
FIGS. 6A and 6B are longitudinal cross-sectional views through telescoping locking elements taken along lines 6A—6A and 6B—6B of FIG. 4, respectively.
Figure 6B:
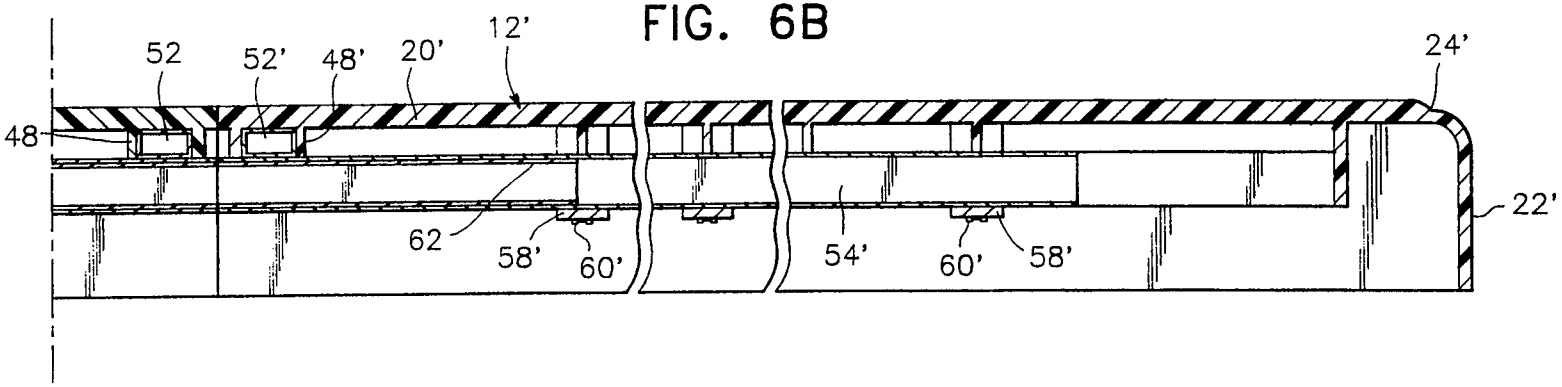

The leg assemblies 16, 16' have respective cross-bars 28, 28' by which they are pivoted to the table top halves. For example, the cross-bars may pivotally snap-fit into respective journals 30, 30 (FIG. 7) molded with the table top halves. To releasably lock the leg assemblies in the open position shown in FIG. 2, the leg assemblies have lockable bracing links 32, 32', pivotally connected to support links 34, 34' which are themselves pivotally attached to support pads 36, 36' screwed or otherwise suitably attached to molded plate sections on the undersurfaces of the table top halves. Slidable locking sleeves 38, 38' are provided to fit over the joint between the links 32, 32' and 34, 34' for releasably locking the leg assemblies in the open position. The leg assemblies may include base bars 40, 40' which may snap fit into retainers 42, 42' (FIG. 8) molded with the table top halves. An alternative configuration of leg assembly 17 is shown in FIG. 13.

Figure 5:
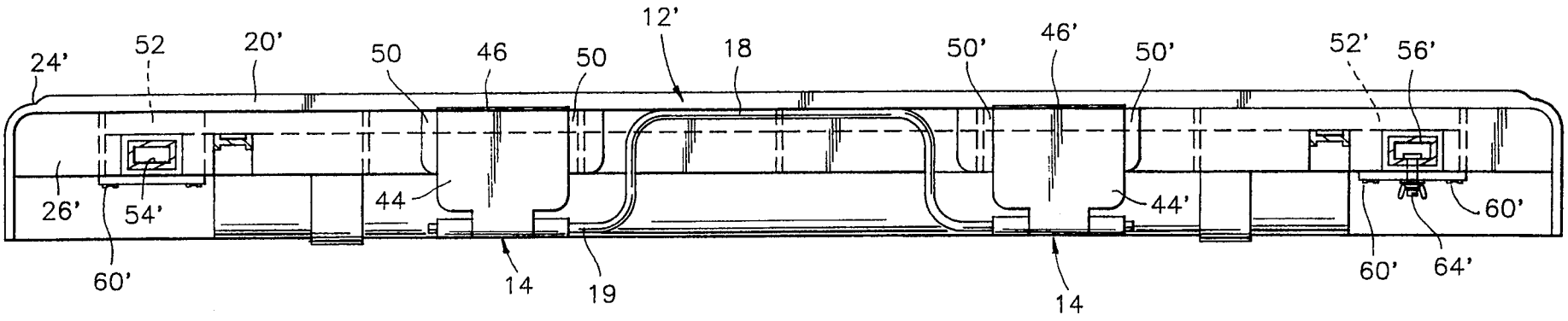
FIG. 5 is a transverse cross-sectional view on line 5—5 of FIG. 4.
Figure 12:
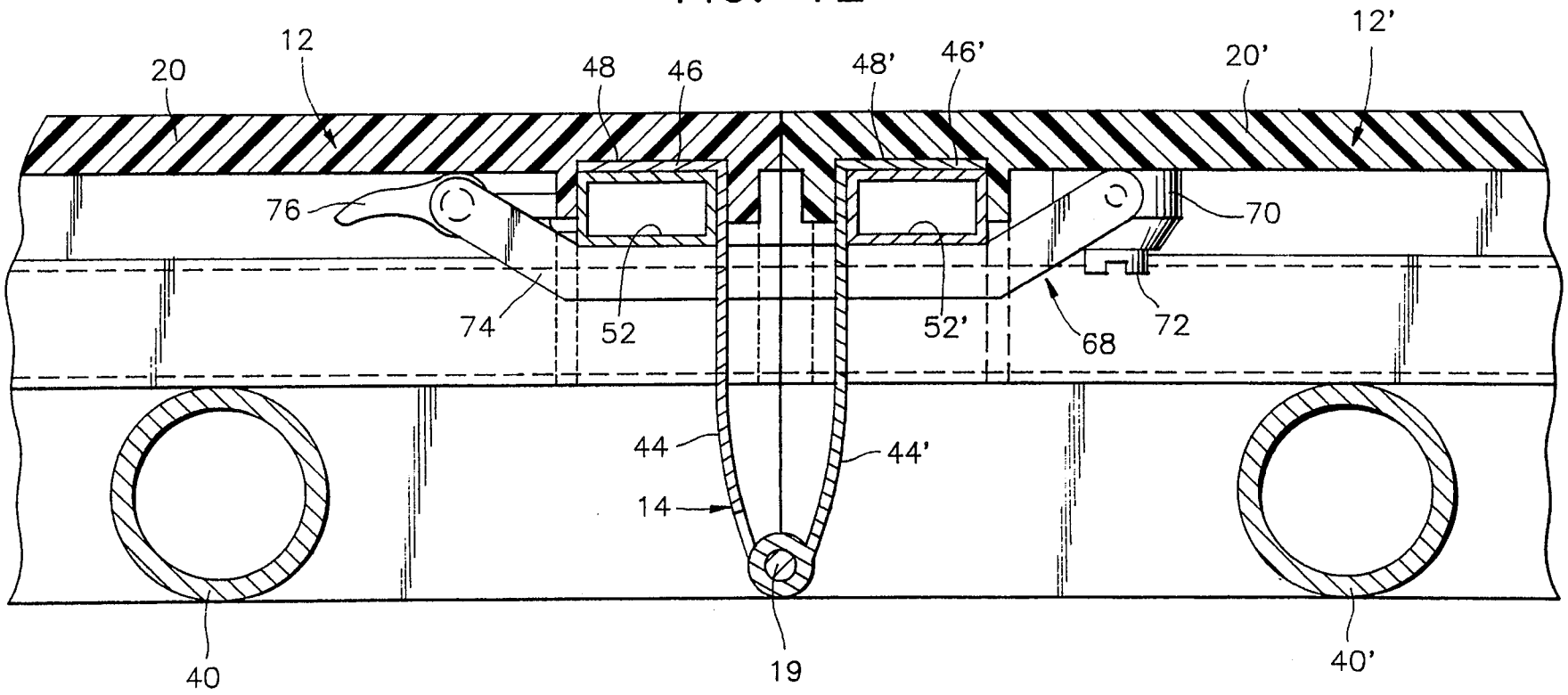
FIG. 12 is an enlarged cross-sectional view on line 12—12 of FIG. 4.

The hinge assemblies 14 include respective hinge plates 44, 44' connected by the hinge pin 19 and perpendicular flanges 46, 46' at the bottom of the hinge plates (see particularly FIG. 12). The table top halves are formed with molded transverse channels 48, 48' adjacent their inner edges and the hinge plates 44, 44' locate in pockets 50, 50' on the inner channel wall with the flanges located on the bases of the respective channels. Transverse metal reinforcing bars 52, 52' fit in the channels over the flanges to hold the hinge assemblies in place and also to rigidify the table top. As evident in FIG. 5, when the table top is open the pivot axis of the hinge assemblies, as defined by hinge pin 19, is below the upper surface of the table top, whereby the handle 18 is concealed between the table top halves.

The reinforcing bars 52, 52' are themselves held in place at their opposite ends by longitudinally extending tubular members 54, 54' and 56, 56' forming respective female elements of telescopic table reinforcing bar assemblies and the inner ends of which fit over the opposite end of bars 52, 52'. The tubular members are secured to the respective table top halves with straps or brackets 58, 58' and screws 60, 60' fitting in molded sockets or the like in the table top halves. The screws thus effectively constitute the only fasteners needed to secure the longitudinal reinforcing bar assemblies as well as the transverse reinforcing bars and hinge assemblies to the table top halves. The longitudinal reinforcing bar assemblies further include male longitudinal reinforcing bars 62, 62' slidably received in the respective tubular members 54, 56' for extending movements into the tubular members 54, 56 when the table top is opened out to provide longitudinal bracing of the table top, and for retracting movements back into the tubular members 54, 56' when the table is to be folded for transport and storage. The bars 62, 62' carry screw and wing nut assemblies 64, 64' which travel in slots 66, 66' in the tubular members 54, 56' which allow the bars 62, 62' to be locked in both the extended and retracted positions, while the length of the slots define the length of travel of the bars. As illustrated, the tubular members 54, 54' carrying the bars 62, 62' are on the opposite table top halves, however they may, alternatively, be on the same table top half.

Figure 4:
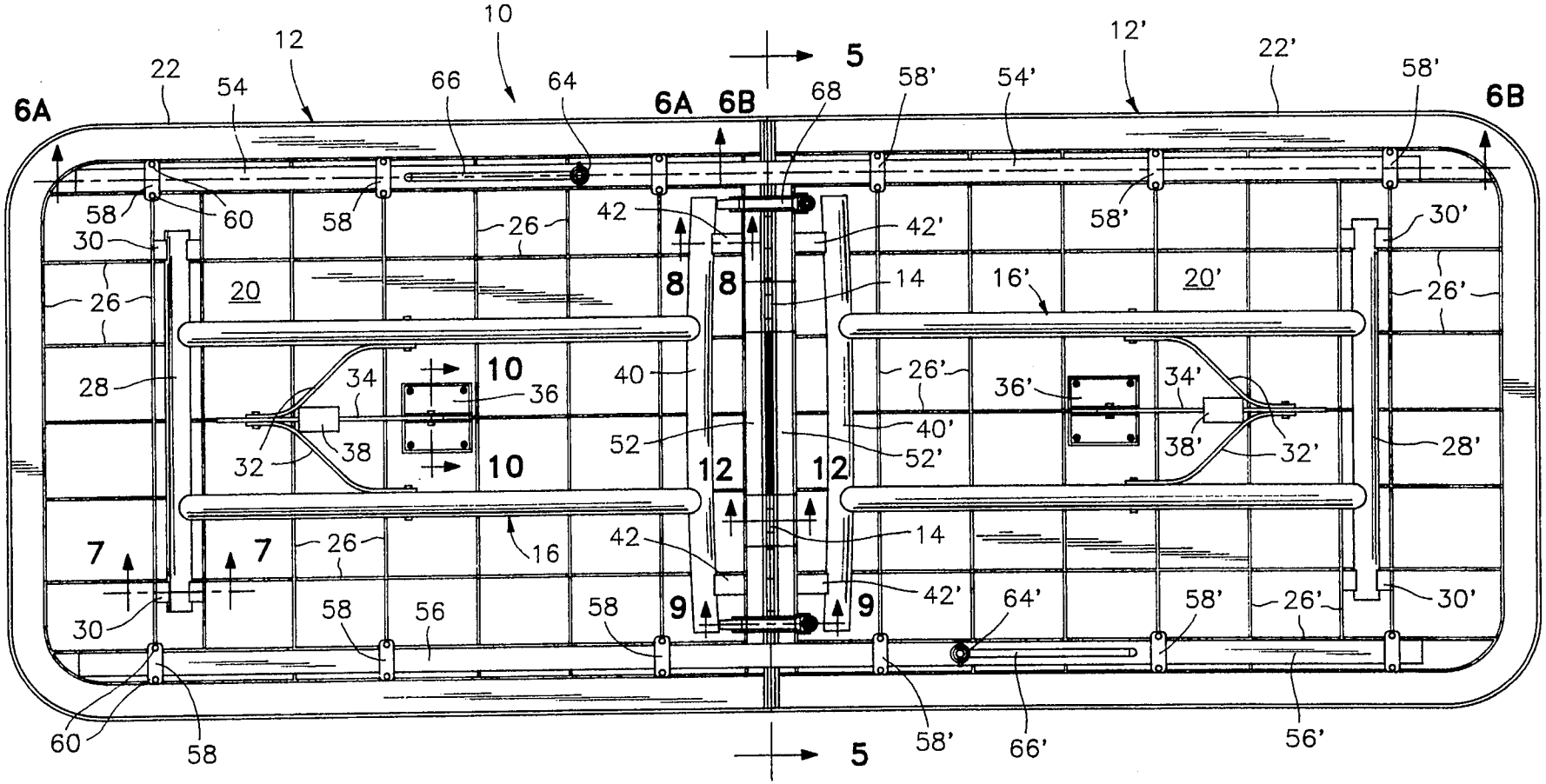
FIG. 4 is a bottom plan view of the table unfolded and with the legs collapsed.
Figure 9:
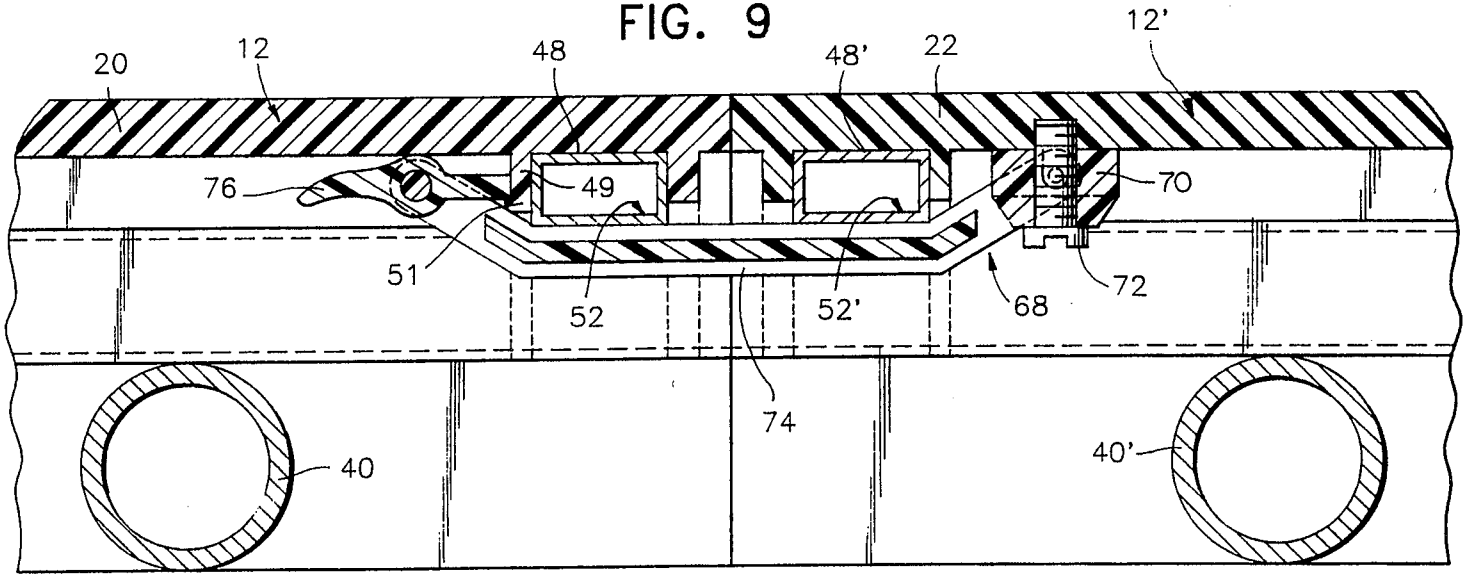
FIG. 9 is an enlarged cross-sectional view on line 9—9 of FIG. 4 and illustrating a snap-over-center latching means to provide the table with rigidity in its unfolded assembled position.
Figure 10:
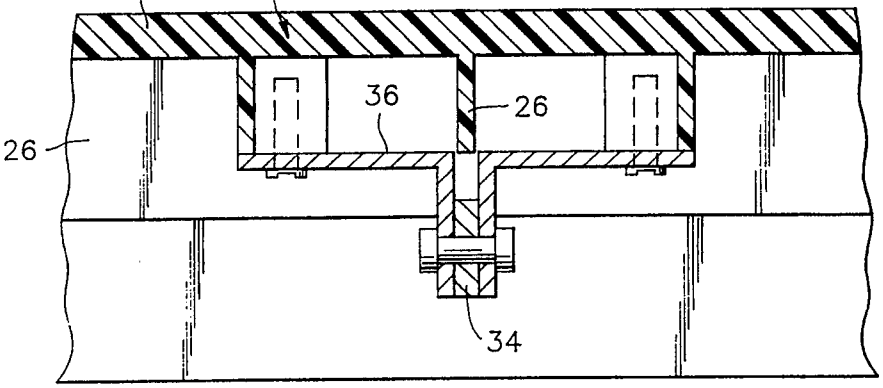
FIG. 10 is an enlarged cross-sectional view on line 10—10 of FIG. 4, showing a pivotal connection of a support for the folding legs to the underside of the table.
Figure 11A:
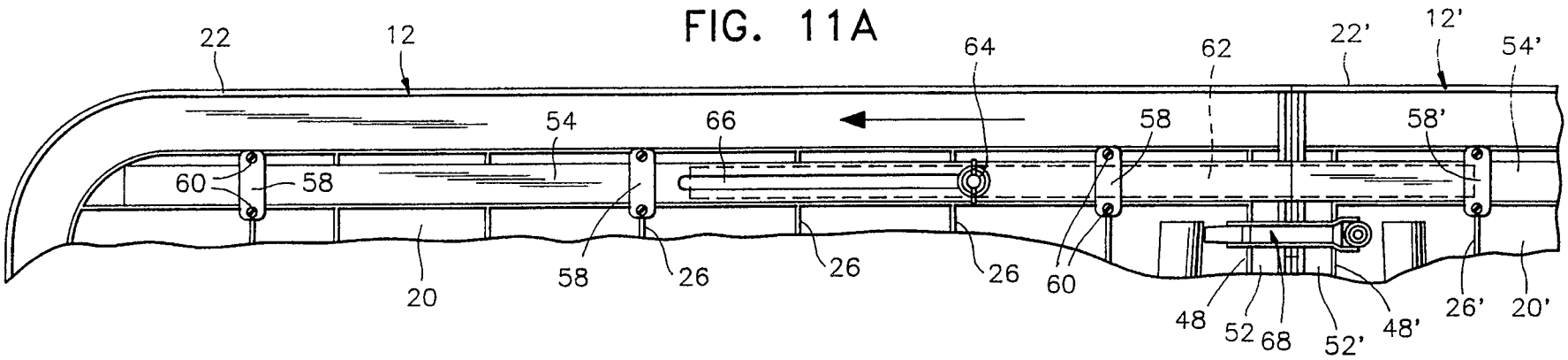
FIG. 11A and 11B are, respectively, views of a telescoping locking element in its locking position and in its withdrawn position.
Figure 11B:
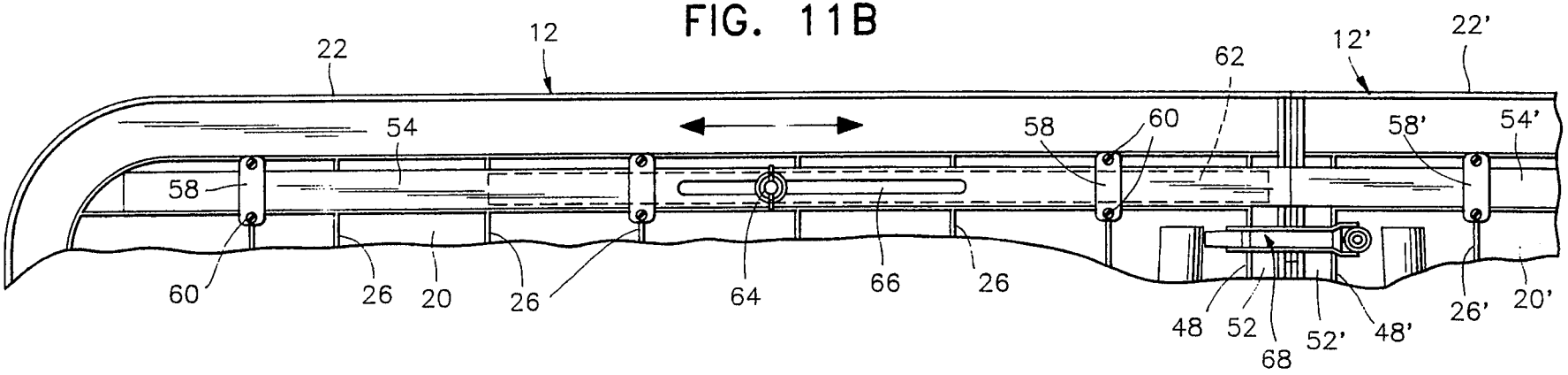

As shown in FIGS. 4 and 9, the table may include latch assemblies 68, for locking over the transverse reinforcing bars 52, 52' to further rigidify the table top when it is open and ensure that the table top halves fit closely together at the transverse center-line of the table. The latch assemblies comprise hubs 70, attached to table top half 12' by screws 72, arms 74, pivotally secured to the hubs, and pivotal toggle links 76, at the ends of the arms. When the table is open, the arms swing across the reinforcing bars 52, 52' and the links 76, are engaged behind the outer walls 49, of channel 48, which may be provided with a catch retaining lip 51, for this purpose.

It is evident from the above that the invention provides a folding table which is simple and economical to manufacture. When assembling the structure, the only fasteners required are the screws for the longitudinal reinforcing bar assemblies, the screws for the folding leg pads, and the screws for the latch assemblies. All the remaining parts of the table hardware simply fit into suitable receiving formations molded into the table top halves. Further, the table is convenient to transport by means of the handle which is exposed only when the table is folded, and storage of plural tables is facilitated by the nesting and stacking configuration. The table is simple to set up and take down by suitably pivoting the leg assemblies, sliding and locking in place the longitudinal reinforcing bars and manipulating the latch assemblies. Also, in the open position, the molded plastic table top is rigidified and reinforced by the longitudinal and transverse reinforcing bars and the latch assemblies.

While only a preferred embodiment of the invention has been described herein in detail, the invention is not limited thereby and modifications can be made within the scope of the attached claims.

I claim:

1. A folding table comprising a table top formed of a pair of molded plastic table top halves and hinge means securing the table top halves together along a transverse center line of the table top for folding the table top halves together into a closed position in which the table top halves are substantially juxtaposed in adjacent planes and an open position in which the table top halves are substantially coplanar, a pair of metal leg assemblies, pivotal attachment means securing the respective leg assemblies to undersurfaces of the respective table top halves for swinging movements of the leg assemblies when the table top is in the open position between folded positions wherein the leg assemblies are substantially juxtaposed against the the leg assemblies are substantially juxtaposed against the undersurfaces of the table top halves and unfolded positions wherein the leg assemblies are substantially perpendicular to the table top halves, and a pair of longitudinal telescopic reinforcing assemblies, each reinforcing assembly comprising a pair of coaxial tubular members each secured along a substantial length of the undersurface of a respective table top half perpendicularly to said center line, and a longitudinal male reinforcing bar slidingly received in one of said tubular members for extending movements across the center line into the other of said tubular members when the table top is in the open position to rigidify the table top, and for retracting movements back into said one of the tubular members when the table top is in the open position to rigidify the table top, and for retracting movements back into said one of the tubular members when the table top is to be folded into the closed position the table further including a pair of transverse metal reinforcing bars secured to the undersurface of the respective table top halves parallel to said center line, wherein the transverse metal supporting bars are located adjacent said center line and fit over portions of the hinge means thereby securing the hinge means to the respective table top halves.

2. A table as defined in claim 1, wherein the hinge means comprises a pair of hinges each comprising hinge plates connected by a hinge pin and flanges extending substantially perpendicularly from the hinge plates, wherein the table top halves include respective molded channels receiving the respective transverse reinforcing bars and wherein the respective hinge plates fit against side walls of the channels and the flanges fit along base walls of the channels under the respective transverse reinforcing bars.

3. A table as defined in claim 2, wherein the side walls of the channels have pockets receiving the hinge plates and transversely locating the hinges.

4. A table as defined in claim 1, wherein inner end portions of the respective tubular members fit over outer end portions of the respective transverse reinforcing bars thereby securing the transverse reinforcing bars to the table top halves.

5. A table as defined in claim 4, including fastener means attaching the tubular members to the respective table top halves.

6. A table as defined in claim 2, wherein inner end portions of the respective tubular members fit over outer ends of the respective transverse reinforcing bars thereby securing the transverse reinforcing bars in said channels and wherein the table includes fastener means securing the tubular members to the table top halves.

7. The table as defined in claim 1, wherein the transverse supporting bars are located adjacent said transverse center line of the table and wherein the table further includes at least one latch assembly secured to the undersurface of one of the table top halves for releasably gripping a portion of the other table top half over the transverse support bars when the table top is in the open position so as to rigidify the table top and retain adjacent edges of the table top halves in proximity along said center line.

8. A table as defined in claim 1, wherein said pivotal attachment means for each leg assembly comprises a cross-bar on the leg assembly and spaced molded bearing assemblies on the undersurface of the respective table top half in which the cross-bar is rotatably snap-fitted.

9. A table as defined in claim 8, including a brace assembly for each leg assembly for releasably locking the leg assembly in the open position, the brace assembly comprising a base plate secured to the undersurface of the respective table top half, a first link means pivotally connected to the base plate, a second link means pivotally connected to the leg assembly, a pivot joint between the first and second link means, and a sliding sleeve on one of the link means for sliding over said pivot joint when the leg assembly is in the unfolded position to releasably lock the link means and prevent movement of the leg assembly to the folded position until the sleeve is moved from over said joint.

10. A folding table comprising a table top formed of a pair of molded plastic table top halves and hinge means securing the table top halves together along a transverse center line of the table top for folding the table top halves together into a closed position in which the table top halves are substantially juxtaposed in adjacent planes and an open position in which the table top halves are substantially coplanar, a pair of metal leg assemblies, pivotal attachment means securing the respective leg assemblies to undersurfaces of the respective table top halves for swinging movements of the leg assemblies when the table top is in the open position between folded positions wherein the leg assemblies are substantially juxtaposed against the undersurfaces of the table top halves and unfolded positions wherein the leg assemblies are substantially perpendicular to the table top halves, and a pair of longitudinal telescope reinforcing assemblies, each reinforcing assembly comprising a pair of coaxial tubular members each secured along a substantial length of the undersurface of a respective table top half perpendicularly to said center line, and a longitudinal male reinforcing bar slidingly received in one of said tubular members for extending movements across the center line into the other of said tubular members when the table top is in the open position to rigidify the table top, and for retracting movements back into said one of the tubular members when the table top is in the open position to rigidify the table top, and for retracting movements back into said one of the tubular members when the table top is to be folded into the closed position wherein the hinge means comprises a hinge pin, a first paid of hinge plates on one end of the hinge pin, a second pair of hinge plates on an opposite end of the hinge pin, the hinge plates being secured to the respective table top halves, wherein a central portion of the hinge pin defines a carrying handle for the table, the handle being exposed when the table top is in the closed position and concealed between the table top halves when the table top is in the open position.

11. A table as defined in claim 10, wherein the ends of the hinge pin define a hinge axis for the table top halves said axis being spaced below a top surface of the table top when the table top is in the open position, and wherein the hinge pin is bent so that the central portion defining the handle is offset from the ends.

12. A folding table comprising a table top formed of a pair of table top halves and hinge means securing the table top halves together along a transverse center line of the table top for folding the table top halves are substantially juxtaposed in adjacent planes and an open position in which the table top halves are substantially coplanar, folding leg assemblies attached to undersurfaces of the respective table top halves, and a carrying handle for the table mounted between the table top halves along said center line for exposure when the table top is in the closed position and concealment between the table top halves when the table top is in the open position wherein the hinge means comprises a pair of hinges mounted at opposite ends of a common hinge pin, each hinge comprising hinge plates secured to the respective table top halves, and wherein the handle is formed by a central portion of the hinge pin between said ends.

13. A table as defined in claim 12, wherein said ends of the hinge pin define a hinge axis for the table top halves which is displaced below an upper surface of the table top when the table top is in the open position, and wherein the central portion of the hinge pin defining the handle is offset from the ends of the hinge pin.

14. A table as defined in claim 12, wherein the hinge plates have perpendicular flanges at their free ends and are located in transverse channels formed in undersurfaces of the respective table top halves, wherein the hinge plates are received in locating pockets formed in side walls of the channels, said flanges are received on base walls of the channels and further wherein the table includes transverse reinforcing bars received in said channels over said flanges for retaining the hinges in place and rigidifying the table top.

15. A table as defined in claim 14, further including longitudinal members attached to the undersurfaces of the table top halves, the longitudinal members having end portions extending over end portions of the transverse reinforcing bars for retaining the transverse reinforcing bars in said channels.

16. A folding table comprising a table top having a pair of table top halves, a pair of spaced hinges connecting the table top halves together for folding and unfolding about a transverse center line of the table, and a hinge pin having end portions carrying hinge plates of the respective hinges and a central portion forming a carrying handle for the table which is exposed when the table top halves are folded together and concealed between the table top halves when the table top halves are opened out into a substantially coplanar configuration.

17. A folding table according to claim 16, wherein the central portion of the hinge pin is offset from the end portions.

18. A folding table comprising a table top formed of a pair of molded plastic tray-like table top halves and hinge means securing the table top halves together along a transverse center line of the table for folding the table top halves together into a closed position in which the table top halves are substantially juxtaposed in adjacent planes and an open position in which the table top halves are substantially coplanar, folding leg assemblies attached to undersurfaces of the respective table top halves, at least one transverse metal reinforcing bar on the undersurface of each table top half, a pair of transversely spaced longitudinal metal reinforcing elements for each table top half and fastener means securing the longitudinal reinforcing elements to the undersurface of each table top half over the respective transverse reinforcing bar whereby the transverse reinforcing bars are held in place by the longitudinal reinforcing elements.

* * * * *